US011585138B2

(12) United States Patent
Buschermöhle et al.

(10) Patent No.: US 11,585,138 B2
(45) Date of Patent: Feb. 21, 2023

(54) METHOD FOR PIVOTABLY ATTACHING A FURNITURE LID TO A FURNITURE BODY BY MEANS OF A LID FITTING

(71) Applicant: Kesseböhmer Holding KG, Bad Essen (DE)

(72) Inventors: Hermann Buschermöhle, Bersenbrück (DE); Henrik Schengber, Melle (DE); Kai Meyer, Georgsmarienhütte (DE)

(73) Assignee: Kesseböhmer Holding KG, Bad Essen (DE)

( * ) Notice: Subject to any disclaimer, the term of this patent is extended or adjusted under 35 U.S.C. 154(b) by 109 days.

(21) Appl. No.: 17/055,437

(22) PCT Filed: May 3, 2019

(86) PCT No.: PCT/EP2019/061384
§ 371 (c)(1),
(2) Date: Nov. 13, 2020

(87) PCT Pub. No.: WO2019/219408
PCT Pub. Date: Nov. 21, 2019

(65) Prior Publication Data

US 2022/0049532 A1 Feb. 17, 2022

(30) Foreign Application Priority Data

May 17, 2018 (EP) ..... 18173008

(51) Int. Cl.
*E05D 15/40* (2006.01)

(52) U.S. Cl.
CPC ..... *E05D 15/401* (2013.01); *E05Y 2600/528* (2013.01); *E05Y 2900/20* (2013.01)

(58) Field of Classification Search
CPC ..... E05Y 2900/20; E05Y 2600/528; E05D 15/401
See application file for complete search history.

(56) References Cited

U.S. PATENT DOCUMENTS 5,211,457 A * 5/1993 Lupynec ..... E05C 17/32 16/370
5,341,542 A * 8/1994 Hannan ..... E05F 1/1276 16/375

(Continued)

FOREIGN PATENT DOCUMENTS

CN 101772611 A 7/2010
CN 102459794 A 5/2012

(Continued)

OTHER PUBLICATIONS

Communication dated Aug. 20, 2021 by the Chinese Patent Office in Chinese Application No. 201980032832.2.

(Continued)

*Primary Examiner* — Victor D Batson
*Assistant Examiner* — Matthew J Sullivan
(74) *Attorney, Agent, or Firm* — Sughrue Mion, PLLC

(57) ABSTRACT

Furniture including a furniture body with an opening, a furniture lid for closing the opening and defining a lid plane, and a lid fitting including: a base element fixed to a side wall of the furniture body, a pivot arm pivotally attached to the base element, a pivot-arm-side connecting element pivotably connected to the pivot arm, a lid-side connecting element which has a mounting surface arranged parallel to the lid plane and which can be mounted on the pivot-arm-side connecting element by movement relative to the pivot-arm-side connecting element in an assembly direction parallel to the mounting surface, a ramp surface on one of the two connecting elements, which is arranged at an angle to the mounting surface, and a sliding element which is arranged on the other of the two connecting elements and slides along the ramp surface when the lid-side connecting element is moved in the assembly direction.

5 Claims, 9 Drawing Sheets

(56) References Cited

U.S. PATENT DOCUMENTS

| | | | | |
|---|---|---|---|---|
| 9,032,768 | B2 * | 5/2015 | Hauer | E05F 1/1058 70/91 |
| 9,909,346 | B2 * | 3/2018 | Holzapfel | E05F 1/1058 |
| 10,000,962 | B2 * | 6/2018 | Berger | E05D 15/1042 |
| 10,590,688 | B2 * | 3/2020 | Salice | E05F 1/1058 |
| 10,619,393 | B2 * | 4/2020 | Albrecht | A47B 46/005 |
| 10,745,953 | B2 * | 8/2020 | Xu | E05F 1/105 |
| 10,829,976 | B2 * | 11/2020 | Bendefy | E05F 1/1083 |
| 10,881,207 | B2 * | 1/2021 | Sobolewski | F16B 12/14 |
| 11,098,515 | B2 * | 8/2021 | Giovannetti | E05F 1/1058 |
| 11,111,708 | B2 * | 9/2021 | Kruedener | E05D 7/125 |
| 11,234,512 | B2 * | 2/2022 | Sobolewski | E06B 3/5009 |
| 2012/0079684 | A1 * | 4/2012 | Tumler | E05D 15/46 16/319 |
| 2016/0138316 | A1 * | 5/2016 | Finke | F16M 13/02 49/506 |
| 2018/0298661 | A1 * | 10/2018 | Salice | E05D 15/401 |
| 2019/0106918 | A1 * | 4/2019 | Schmid | E05F 1/1058 |
| 2021/0180379 | A1 * | 6/2021 | Held | E05D 15/56 |
| 2021/0259413 | A1 * | 8/2021 | Lobello | A47B 67/02 |
| 2022/0049532 | A1 * | 2/2022 | Buschermöhle | E05D 15/40 |
| 2022/0056747 | A1 * | 2/2022 | Holzapfel | E05F 1/1041 |
| 2022/0074248 | A1 * | 3/2022 | Holzapfel | E05D 3/16 |

FOREIGN PATENT DOCUMENTS

| | | | |
|---|---|---|---|
| CN | 105971432 | A | 9/2016 |
| DE | 29 34 506 | A1 | 3/1987 |
| DE | 200 08 292 | U1 | 8/2000 |
| DE | 200 17 906 | U1 | 3/2001 |
| EP | 2 354 404 | A2 | 8/2011 |
| EP | 2 559 835 | A1 | 2/2013 |
| WO | 2007/045631 | A1 | 4/2007 |
| WO | 2011/011800 | A2 | 2/2011 |
| WO | 2017/193146 | A1 | 11/2017 |

OTHER PUBLICATIONS

Office Action dated May 11, 2021 issued by the Indian Patent Office in Indian Application No. 202017047274.

International Search Report for PCT/EP2019/061384 dated Jul. 17, 2019 (PCT/ISA/210).

* cited by examiner

METHOD FOR PIVOTABLY ATTACHING A FURNITURE LID TO A FURNITURE BODY BY MEANS OF A LID FITTING

CROSS REFERENCE TO RELATED APPLICATIONS

This application is a National Stage of International Application No. PCT/EP2019/061384 filed May 3, 2019, claiming priority based on European Patent Application No. 18173008.6 filed May 17, 2018.

BACKGROUND OF THE INVENTION

Field of the Invention

The invention relates to a method for pivotally attaching a furniture lid to a furniture body by means of a lid fitting. The lid fitting has a base element for mounting the lid fitting on a side wall of the furniture body, with a pivot arm pivotally attached to the base element. A pivot-arm-side connecting element is pivotally connected to the pivot arm. Furthermore, the lid fitting has a lid-side connecting element, which has a mounting surface to which the furniture lid can be attached.

Background

EP 2 354 404 A2 shows a furniture lid wherein the pivot arm is subjected to force in such a way that the pivot arm is subjected to force over its maximum pivot path towards an open position. In addition, a pulling force is also exerted on the pivot arm via a smaller pivot path towards the closed position. The power drive serves to compensate for the weight forces of the furniture lid, which can be connected to the lid-side connecting element, so that the furniture lid is held in any position or can be automatically transferred to the open position by the power drive.

During assembly, the lid fitting is usually first mounted on a side wall of the finished furniture body. To mount the furniture lid, the pivot arm is then transferred to its open position. The furniture lid is then mounted to the lid-side connecting element in the open position of the pivot arm. In particular, if the pivot arm is subjected to force by means of a power drive, as is the case in EP 2 354 404 A2, transferring the pivot arm to the open position represents a source of danger for the technician, as the lack of lid weight means that the pivot arm can accelerate uncontrollably into its open position and can lead to injuries.

EP 2 459 829 B1 shows another lid fitting. In order to simplify the assembly of the furniture lid to such a lid fitting, WO 2017/193146 A1 proposes that the lid fitting has a lid-side fitting body which can be connected to the furniture lid and has a fastening device which is pivotably connected to the pivot arm. The fitting body and the fastening device are designed in such a way that they automatically lock into place in the closed position of the pivot arm by manually pressing the furniture lid towards the end faces of the side walls of the furniture body. The furniture lid is thus mounted in the closed position of the pivot arm in a direction transverse to a plane defined by the end faces of the side walls or by the furniture lid in its closed position.

DE 200 17 906 U1 shows a mounting unit for fixing a swinging drawer to the underside of a hanging piece of furniture. A base plate is attached to the piece of furniture. A bearing plate is attached to the swinging drawer, which is pivotably connected to a mounting bracket via a parallelogram linkage. The mounting bracket is detachably attached to the base plate by means of a suspension and locking device. The suspension and latching device has suspension lugs that project downwards and forward from the base plate. The mounting bracket has an opening and a recess with which the mounting bracket can be slid onto the mounting brackets of the base plate. Thus the base plate is firmly attached to the piece of furniture and the bearing plate can be pivoted in relation to the piece of furniture.

The DE 200 08 292 U1 shows the same mounting unit as the DE 200 17 906 U1 in assembled condition. The mounting unit is fixed in the swinging drawer. My means of the mounting unit, the swinging drawer is mounted on the outside underneath a piece of furniture so that it can swing.

The object of the present invention is to provide a method for pivotally attaching a furniture lid to a furniture body by means of a lid fitting and a furniture having a furniture body and a furniture lid for closing an opening of the furniture body, the furniture lid being connected to the furniture body by means of its lid fitting, wherein the furniture lid can be mounted in the closed position.

SUMMARY OF THE INVENTION

The object is achieved by means of a method for pivotally attaching a furniture lid to a furniture body by means of a lid fitting, the lid fitting comprising a base element and a to pivot arm pivotally attached to the base element. A pivot-arm-side connecting element is pivotally connected to the pivot arm. A lid-side connecting element has a mounting surface parallel to the lid plane. A ramp surface is arranged on one of the two connecting elements at an angle to the mounting surface in the assembly direction. A sliding element is arranged on the other of the two connecting elements. The method has the following steps:

- Fastening the base element to a side wall of the furniture body in such a way that the pivot-arm-side connecting element is arranged inside the furniture body,
- Fastening the lid-side connecting element to the furniture lid,
- Placing the furniture lid against an opening in the furniture body and
- Moving the furniture lid relative to the pivot-arm-side connecting element in a assembly direction parallel to the mounting surface in such a way that the sliding element slides along the ramp surface and the pivot-arm-side connecting element is pulled towards the lid-side connecting element in the direction towards the opening of the furniture body.

The ramp surface is arranged at an angle to the mounting surface in such a way that the ramp surface forms an angle of more than 0 degrees and less than 90 degrees with the mounting surface. The ramp surface can have a course that the angle to the mounting surface changes over the longitudinal extension of the ramp surface.

Fastening the base element to the side wall of the furniture body may involve transferring the lid fitting to an assembly position in which the pivot-arm-side connecting element is located completely within the furniture body.

By moving the lid fitting into the assembly position, the pivot-arm-side connecting element is arranged offset inwards at a first distance from an opening plane of the furniture body.

The furniture lid may be moved relative to the pivot-arm-side connecting element until it reaches an assembled state in which the pivot-arm-side connecting element is moved away from the assembly position in the direction towards the open position.

The furniture lid can be moved relative to the pivot-arm-side connecting element until it reaches an assembled state in which the pivot-arm-side connecting element projects outwards from the furniture body by a second distance.

The piece of furniture may comprise a furniture body with an opening, a furniture lid for closing the opening, the furniture lid defining a lid plane, and a lid fitting, the lid fitting comprising

- a base element fixed to a side wall of the furniture body,
- a pivot arm, which is pivotally attached to the base element,
- a pivot-arm-side connecting element, which is pivotably connected to the pivot arm,
- a lid-side connecting element, which has a mounting surface arranged parallel to the lid plane and which can be mounted on the pivot-arm-side connecting element by movement relative to the pivot-arm-side connecting element in an assembly direction parallel to the mounting surface,
- a ramp surface on one of the two connecting elements, which is arranged at an angle to the mounting surface, and
- a sliding element which is arranged on the other of the two connecting elements and slides along the ramp surface when the lid-side connecting element is moved in the assembly direction.

As the sliding element slides along the ramp surface, which is inclined to the assembly direction, the pivot-arm-side connecting element is drawn to the lid-side connecting element in accordance with the inclined position of the ramp surface.

The lid fitting can thus be mounted on the side wall of a furniture body in such a way that the pivot-arm-side connecting element is pivoted into the furniture body in the unmounted state of the lid-side connecting element, i.e. behind a plane formed by an opening in the furniture body. For mounting the furniture lid, with which the opening is to be closed, the pivot arm does not have to be moved to the open position. By moving the furniture lid and thus the lid-side connecting element in the assembly direction parallel to the plane of the opening, the sliding element sliding along the ramp surface pulls the pivot-arm-side connecting element towards the opening onto the lid-side connecting element and, if necessary, pulls it slightly out of the furniture body. The pivot arm is thus moved from an assembly position arranged in the furniture body into a closed position arranged slightly towards the open position.

For further assembly of the lid-side connecting element, it may be provided that the pivot arm is transferred to its open position, whereby the lid-side connecting element remains temporarily connected to the pivot-arm-side connecting element. This prevents the pivot arm from jumping uncontrolled into the open position, as the weight of the furniture lid now counteracts a possible force from a power drive of the lid fitting.

If no power drive is provided, installation is also simplified, as the furniture lid is easier to adjust in the closed position of the pivot arm relative to the furniture body than in the open position, in which the pivot arm protrudes from the furniture body in a movable and unfixed manner.

In an embodiment, the sliding element, in the assembled state of the lid-side connecting element, can be supported against a supporting surface, which is arranged opposite the ramp surface. Thus, the sliding element is supported between the ramp surface and the supporting surface so that the sliding element cannot be moved transversely to the assembly direction relative to the pivot arm-side connecting element. Pre-fixing of the lid-side connecting element to the pivot arm-side connecting element is thus guaranteed in both directions transverse to the assembly direction.

When the lid-side connecting element is mounted, the sliding element can engage behind locking projections arranged on the ramp surface and on the supporting surface. Thus, the sliding element is also, at least provisionally, secured against displacement in the opposite direction to the mounting surface.

In addition, the lid fitting can have a fixation device by means of which the lid-side connecting element is fixed in the assembled state to the pivot-arm-side connecting element to prevent displacement against the assembly direction.

The fixation device may be designed with a latching element on one of the two connecting elements which, when the lid-side connecting element is in the assembled state, engages behind a catch hook on the other of the two connecting elements and is supported and held against the catch hook against the assembly direction.

The catch hook may be designed in such a way that it is adjustable between a release position and a fixing position, the catch hook having an insertion slope which is arranged at an acute angle to the assembly direction. Thus, by moving the sliding element in the assembly direction, the sliding element can transfer the catch hook from the fixing position to the release position by sliding along the insertion slope and, as soon as the sliding element engages behind the catch hook, allow the catch hook to jump back into the fixing position.

For this purpose, the catch hook may be spring-loaded to assume its fixing position. The catch hook can also have an unlocking lever for manual operation of the catch hook so that it can be manually transferred from its fixing position to the release position.

In an exemplary embodiment, the lid fitting has a securing element on one of the two connecting elements which, when the lid-side connecting element is in the assembled state, is arranged in a securing recess on the other of the two connecting elements and is supported in this recess transversely to the assembly direction or transversely to the fixing plane. This ensures that the lid-side connecting element is further secured against adjustment transverse to the assembly direction. In particular, if the securing element is arranged at a distance from the sliding element in the assembly direction, tilting of the lid-side connecting element relative to the pivot-arm-side connecting element is prevented.

In one embodiment, the latching element can be the securing element.

The method for the pivotably attachment of a furniture lid to a furniture body is explained in more detail below by reference to an exemplary embodiment of a furniture unit with lid fittings.

BRIEF DESCRIPTION OF THE DRAWINGS

Herein

DETAILED DESCRIPTION OF THE INVENTION

Figure 1:
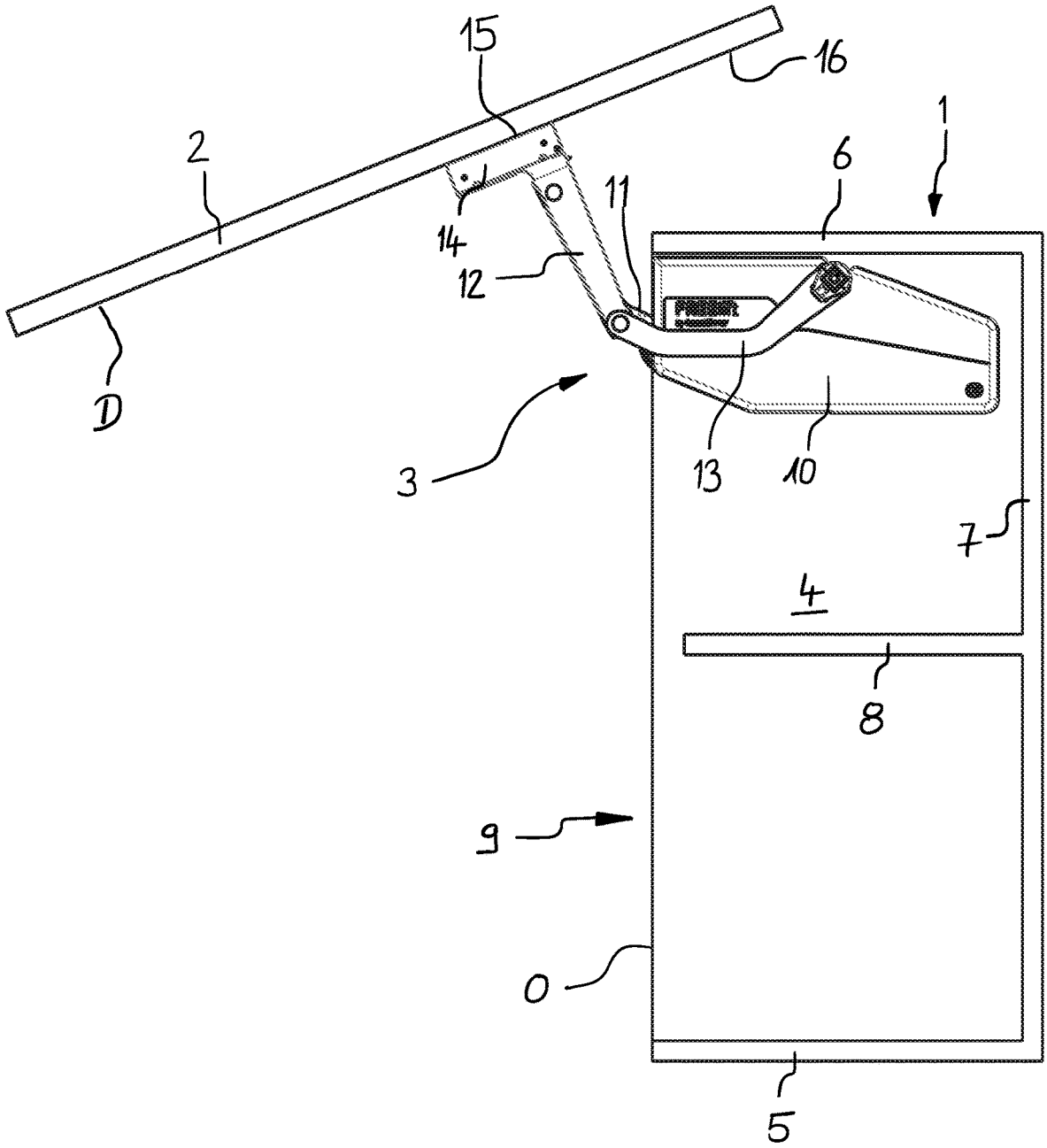
FIG. 1 is a longitudinal sectional view through a piece of furniture with a lid fitting in its open position.

FIG. 1 shows a piece of furniture with a furniture body 1 and a furniture lid 2, wherein the furniture lid 2 is connected to the furniture body 1 by two lid fittings, of which one lid fitting 3 can be seen. The furniture body 1 has two parallel and vertically orientated side walls 4, of which one side wall 4 is visible. Furniture body 1 also has a bottom panel 5 and a top panel 6, which close the furniture body 1 at the top or bottom. At the rear, the furniture body 1 is closed off by a rear panel 7. Inside the furniture body 1 there is an intermediate shelf 8. On each side wall a lid fitting 3 is mounted.

Figure 2:
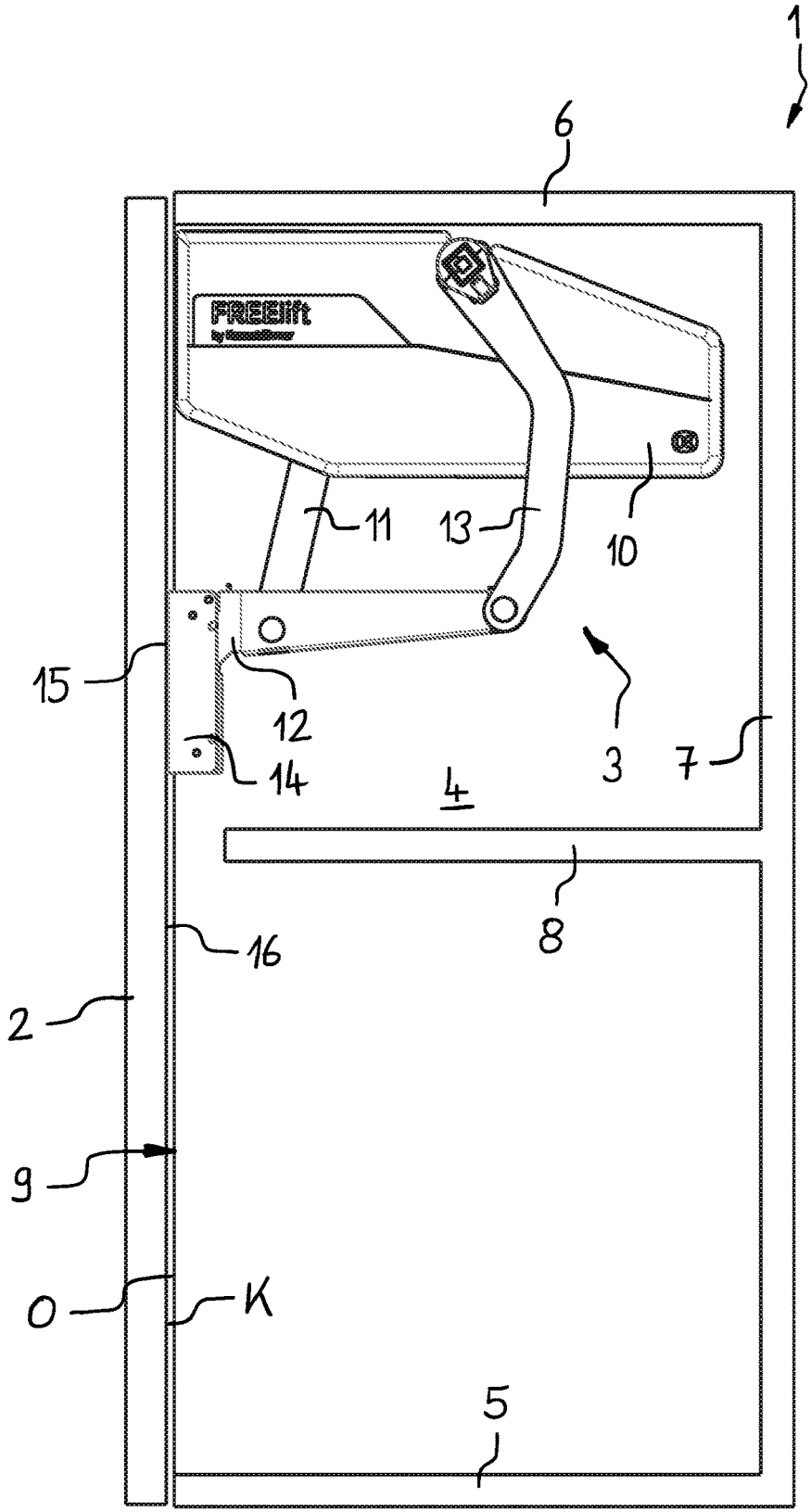
FIG. 2 is a longitudinal sectional view of the piece of furniture as shown in FIG. 1 with the lid fitting in its closed position.
Figure 3:
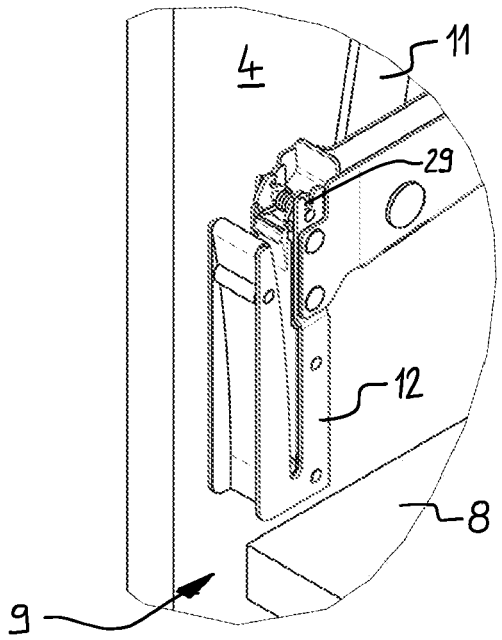
FIG. 3 is an enlarged perspective view of the pivot arm-side connecting element.
Figure 4:
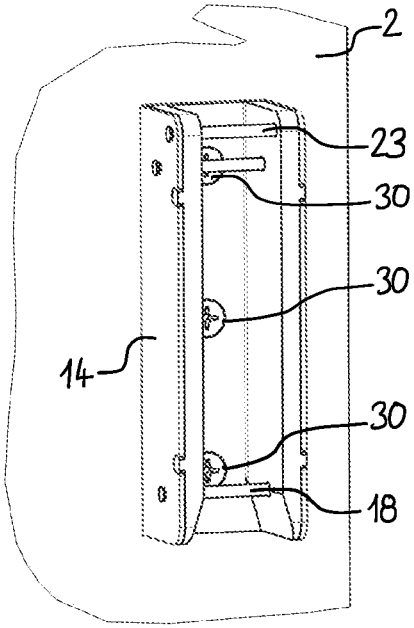
FIG. 4 is an enlarged perspective view of the lid-side connecting element.

Furniture body 1 has an opening 9 pointing forward, through which the interior of furniture body 1 is accessible in the open position of lid fitting 3 shown in FIG. 1. FIG. 2 shows the lid fitting 3 in its closed position, in which the furniture lid 2 closes the opening 9.

The lid fitting 3 is designed in such a way that it pivots the furniture lid 2, starting from the closed position shown in FIG. 2, to the open position over the top panel 6 of the furniture body 1 shown in FIG. 1. In principle, other lid fittings can also be provided, which adjust the furniture lid in parallel or which operate a furniture lid in the form of a folding lid.

The side walls 4, the bottom panel 5 and the top panel 6 have end faces pointing towards the furniture lid 2, which together form an opening plane O. The opening plane O is arranged vertically in the shown arrangement of furniture body 1. In the closed position of the lid fitting 3, the furniture lid 2 is also in a vertical orientation parallel to the opening plane O. The furniture lid 2 has an inner surface facing towards the furniture body 1, which defines a lid plane D, which in the closed position of the lid fitting 3 is parallel to the opening plane O.

The lid fitting 3 has a base element 10 which is attached to the side wall 4 of the furniture body 1. A pivot arm 11 is attached to the base element 10 so that it can pivot. On the pivot arm 11 a pivot-arm-side connecting element 12 is pivotably attached. To ensure that the pivot-arm-side connecting element 12 in the shown embodiment has a defined sequence of movements when opening and closing the furniture lid 2, a control arm 13 is provided, which is connected pivotably to the base element 10 on the one hand and pivotably to the pivot-arm-side connecting element 12 on the other.

A lid-side connecting element 14 is connected to the pivot arm-side connecting element 12. The lid-side connecting element 14 has a flat mounting surface 15 which lies against the inner surface 16 of the furniture lid 2 and is connected to the furniture lid 2 via the lid-side connecting element 14. For this purpose, the lid-side connecting element 14 is connected to the furniture lid 2 via fastening screws 30 (FIGS. 6 to 10).

Figure 5:
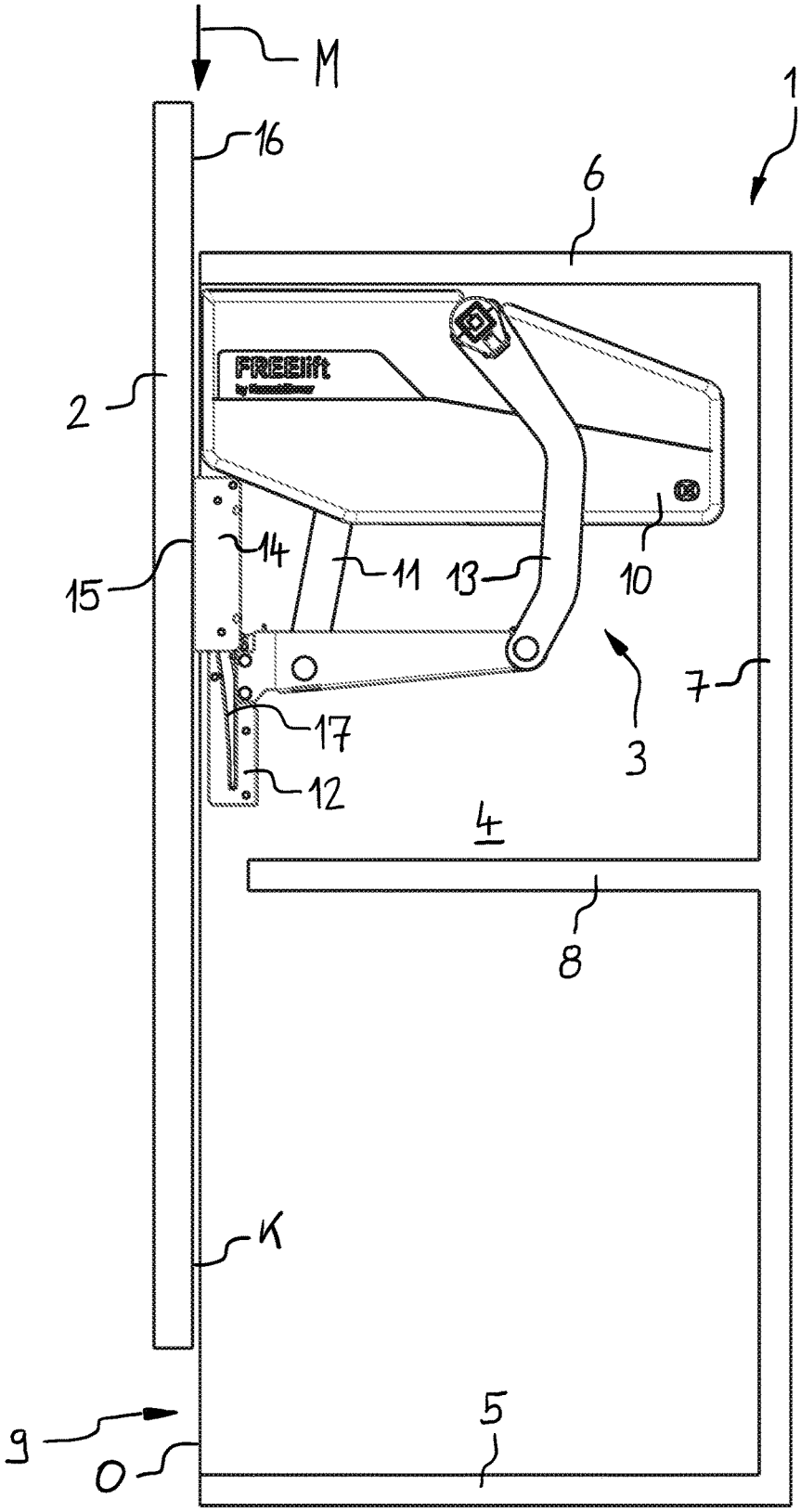
FIG. 5 is a longitudinal sectional view of the piece of furniture according to FIG. 2 with a disassembled lid-side connecting element in an assembly position for the assembly of the lid-side connecting element.
Figure 6:
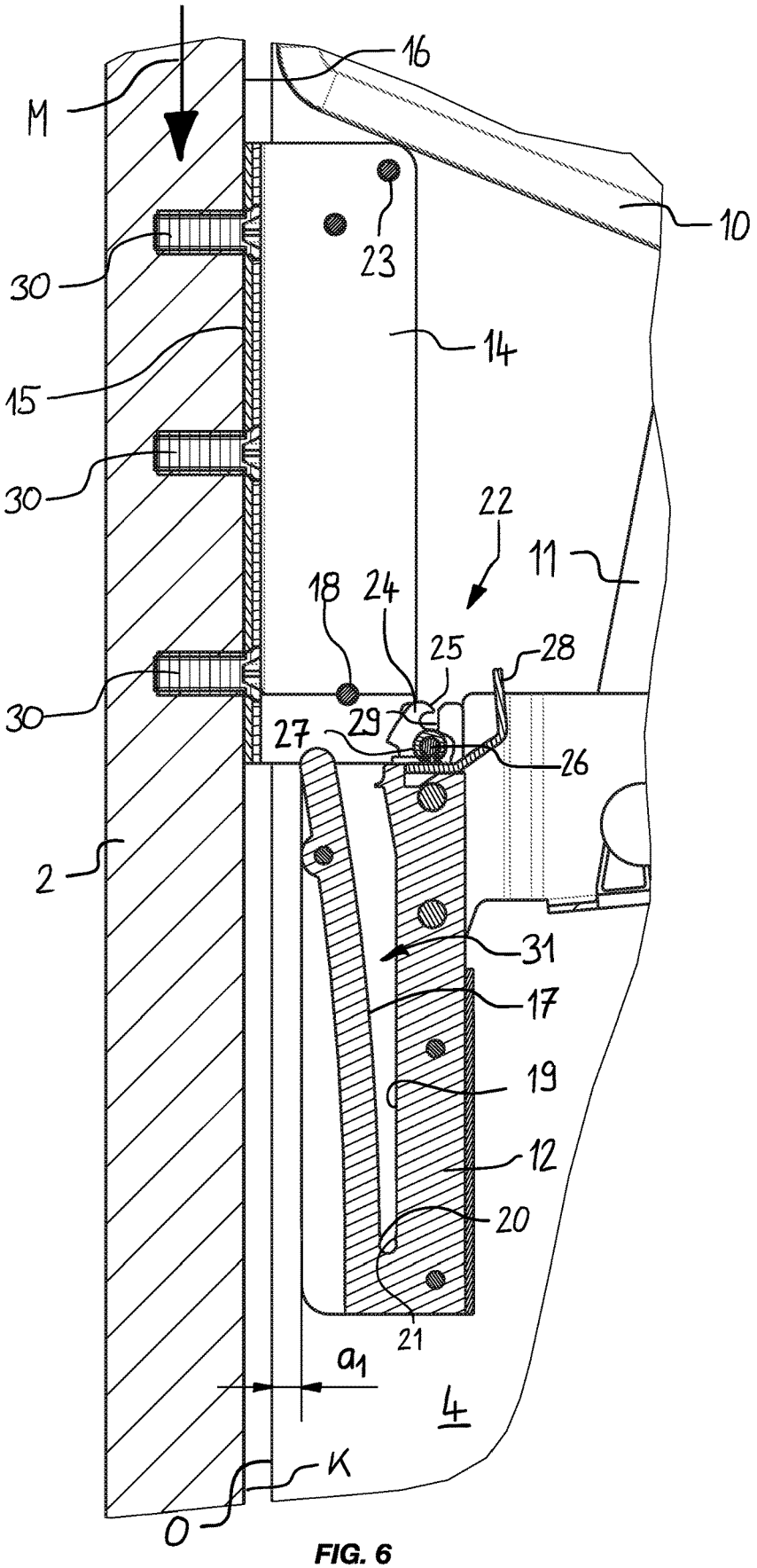
FIG. 6 is a section of the longitudinal sectional view as shown in FIG. 5 in the area of the connecting element.
Figure 10:
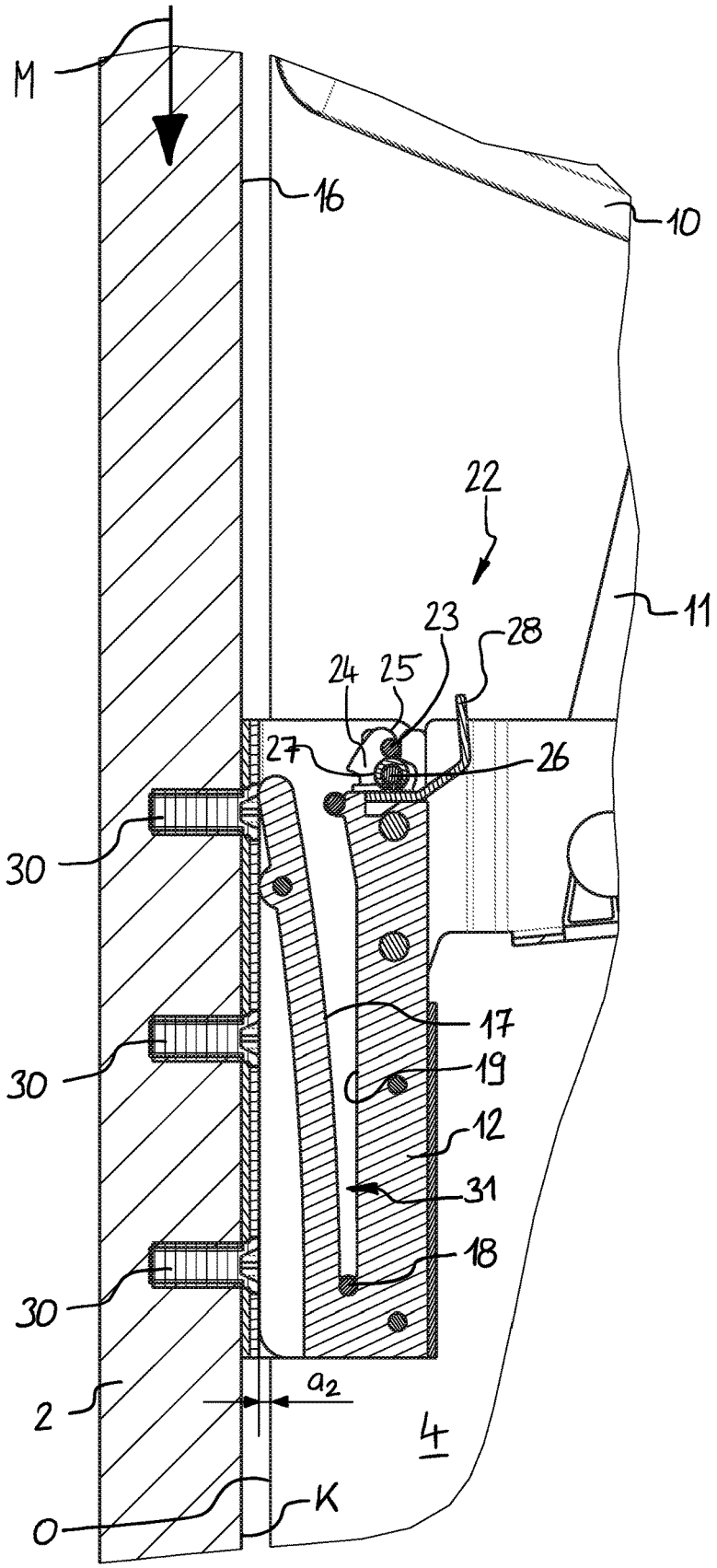
FIG. 10 is a representation of the connecting element as shown in FIG. 9, with the lid-side connecting element shown in its fully assembled state.

FIGS. 5 and 6 show a lateral sectional view of the furniture body 1, with the lid-side connecting element 14 in an assembly position prior to assembly with the pivot-arm-side connecting element 12. When mounting the lid fitting 3, the lid fitting 3 is first attached to the side wall 4 of the furniture body 1 via the base element 10. The lid fitting 3 is in an assembly position close to the closed position. In the assembly position, the pivot-arm-side connecting element 12 is arranged offset inwards in the furniture body 1 by a certain amount. FIG. 6 shows that the pivot-arm-side connecting element 12 is arranged at a first distance a1 from the opening plane O and is therefore completely inside the furniture body 1. When the lid-side connecting element 14 is mounted (FIG. 10), the pivot-arm-side connecting element 12 is pivoted or moved out of the furniture body 1 by a certain amount. FIG. 10 shows that the pivot-arm-side connecting element 12 protrudes outwards from the opening of the furniture body 1 by the distance a2. However, it is not absolutely necessary for the pivot-arm-side connecting element 12 to protrude from the furniture body 1; it is sufficient if it is only moved slightly away from the assembly position towards the open position.

The pivot arm 11 is force-loaded via a power drive not shown in its closed position according to FIG. 10 in the direction towards the assembly position according to FIG. 6, so that the furniture lid 2 is pulled against the furniture body 1 to ensure secure closing of the furniture body 1. In order to compensate for assembly tolerances, there must therefore be a certain adjustment path, starting from the closed position according to FIG. 10, towards the assembly position according to FIG. 6. In principle, it is also possible that the lid fitting 3 does not have a power drive.

Usually, to mount the furniture lid 2, the lid fitting 3 or the pivot arm 11 is moved into its open position so that the pivot arm-side connecting element 12 is outside the furniture body 1 and the lid-side connecting element 14 can be connected to the pivot arm-side connecting element 12.

According to the invention, however, it is provided that the pivot arm 11 is moved out of the furniture body 1 by a transverse movement of the lid-side connecting element 14 in an assembly direction M (FIG. 5) parallel to the lid plane D or parallel to the opening plane O the pivot arm-side connecting element 12 is moved out of the assembly position according to FIG. 6 to the closed position.

For this purpose, the pivot-arm-side connecting element 12 has a ramp surface 17 which runs at an angle to the mounting surface 15 of the lid-side connecting element 14 in the assembly direction M. The lid-side connecting element 14 has a sliding element 18, which is pin-shaped and arranged parallel to the mounting surface 15 or to the lid plane D and perpendicular to the assembly direction M. Alternatively, the ramp surface 17 can also be arranged on the lid-side connecting element 14, in which case the sliding element 18 must be arranged on the pivot-arm-side connecting element 14.

The ramp surface 17 is designed in the illustrated exemplary embodiment in such a way that the distance of the ramp surface 17 to the opening plane O increases in assembly direction M. In the present case, the assembly direction M is vertically aligned so that the lid-side connecting element 14 is moved vertically downwards for mounting. Alternatively, it is also possible that the assembly direction M leads vertically upwards. This can be particularly important if the furniture body 1 has a crown bar on the top panel 6 so that the furniture lid 2 cannot be moved upwards over the furniture body 1 in the opening plane O.

Figure 7:
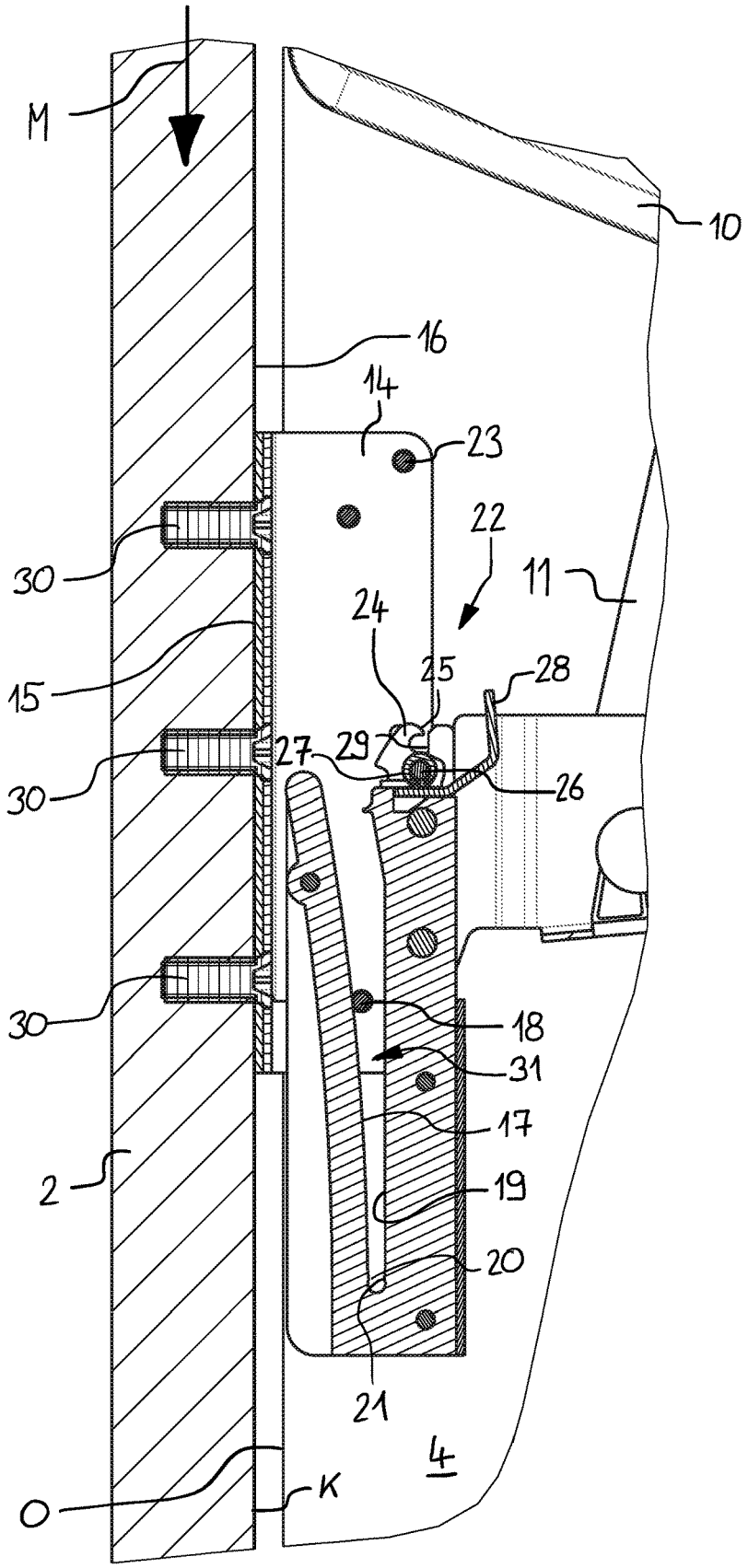
FIG. 7 is a representation of the connecting element as shown in FIG. 6, with the lid-side connecting element displaced in the assembly direction and the sliding element in contact with the ramp surface.
Figure 8:
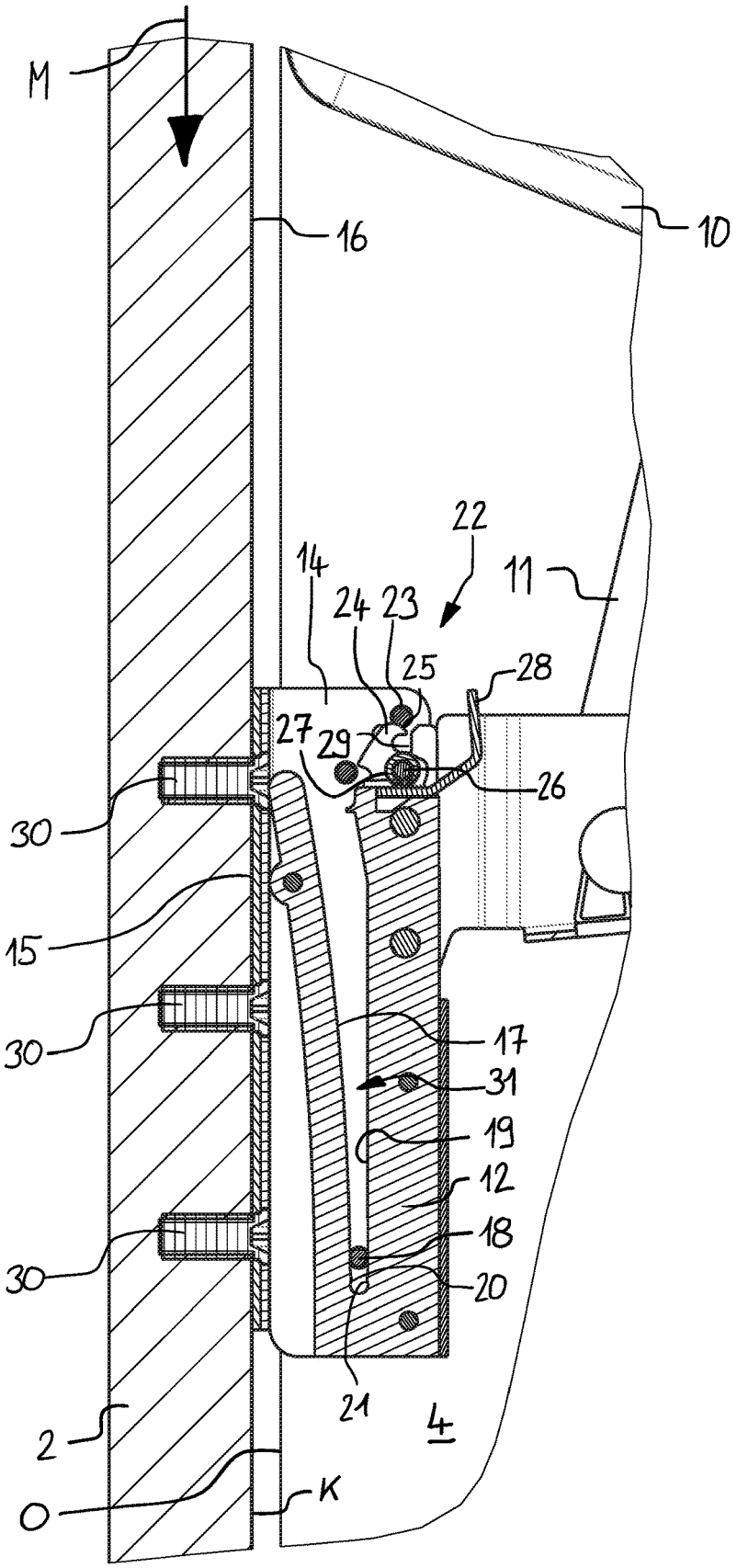
FIG. 8 is a representation of the connecting elements as shown in FIG. 7, with the lid-side connecting element moved further in the assembly direction and the latching element in contact with the insertion slope of the catch hook.

The furniture lid 2 is placed against the opening 9 of the furniture body 1, whereby the sliding element 18 projects further into the opening or is further away from the opening plane O than the smallest distance of the ramp surface 17 to the opening plane O. Thus, when the lid-side connecting element 14 moves in the assembly direction M, the sliding element 18 engages behind the ramp surface 17 and comes into contact with it. When the lid-side connecting element 14 is moved further in assembly direction M, the pivot-arm-side connecting element 12 is pulled out of the furniture body 1 in the direction towards the lid-side connecting element 14 or in the direction towards the furniture lid 2 due to the ramp surface 17 running at an angle to the assembly direction M. In FIG. 7, the pivot-arm-side connecting element 12 has already been pulled out of the furniture body 1 to such an extent that it is approximately flush with the opening plane O.

When the lid-side connecting element 14 continues to move, the sliding element 18 also comes into contact with a supporting surface 19, which is arranged opposite the ramp surface 17. The supporting surface 19 is arranged in such a way that an upwardly opening gap 31 with a wedge-shaped cross-section is formed between the ramp surface 17 and the supporting surface 19, into which the sliding element 18 is immersed. As soon as the sliding element 18 is immersed far enough in this gap 31, it is axially supported against the ramp surface 17 in one direction transverse to the assembly direction M and against the supporting surface 19 in the opposite direction.

At a lower end the ramp surface 17 and the supporting surface 19 are connected by an arch section. In the fully assembled position, the sliding element 18 is located at the bottom of the gap 31 between the ramp surface 17 and the supporting surface 19, whereby the sliding element 18 has passed and locked behind locking projections 20, 21 on the ramp surface 17 and on the supporting surface 19, so that it cannot be pulled out of the gap 31 against the assembly direction without a certain amount of force.

A fixation device 22 is provided for fixing the lid-side connecting element 14 to the pivot arm-side connecting element 12. This has a latching element 23 on the lid-side connecting element 14, which is pin-shaped like the sliding element 18 and is arranged parallel to it. In the assembled state, the latching element 23 engages behind a catch hook 24 of the fixation device 22 on the pivot arm-side connecting element 12 and is secured against displacement against the assembly direction M.

Alternatively, the catch hook 24 can also be arranged on the lid-side connecting element 14 and the latching element 23 on the pivot arm-side connecting element.

Figure 9:
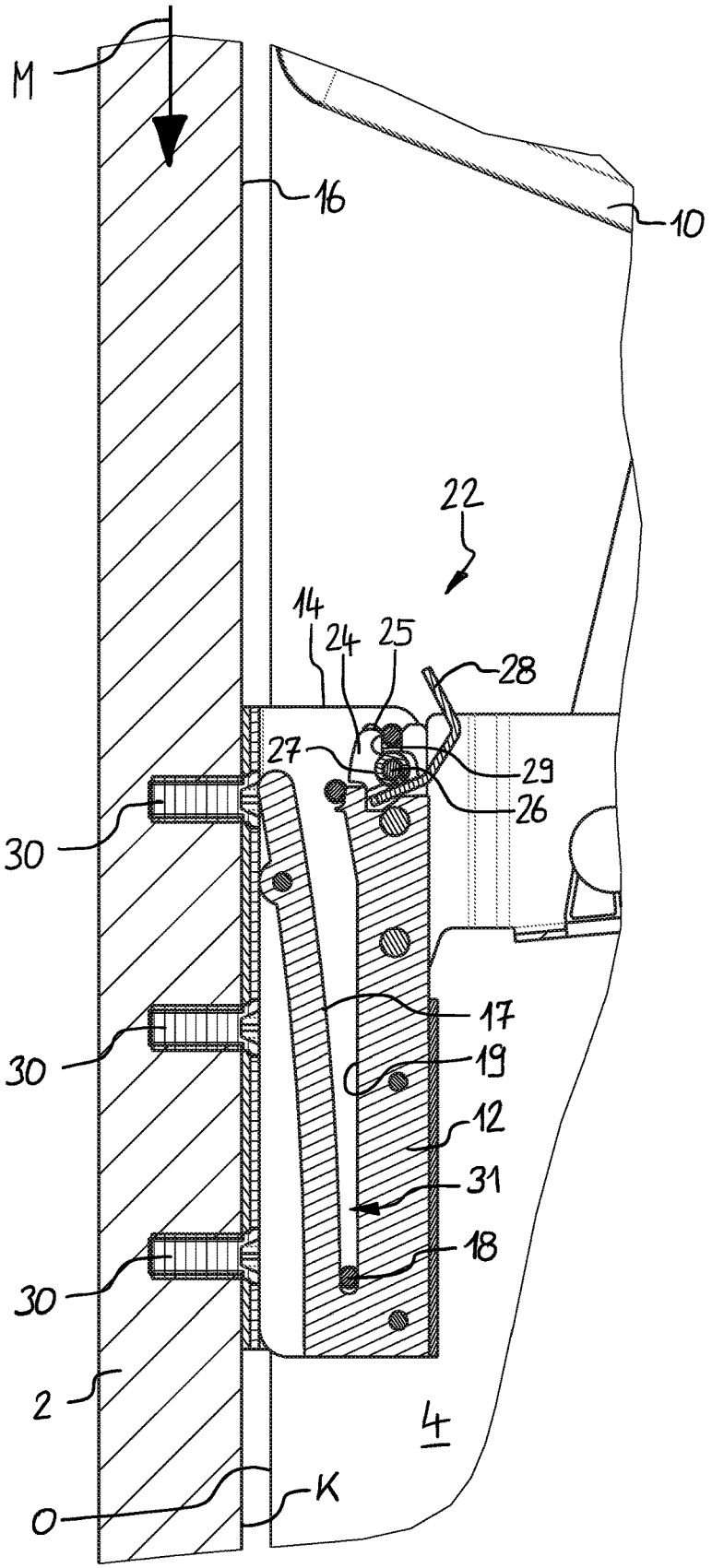
FIG. 9 is a representation of the connecting elements according to FIG. 8, where the lid-side connecting element further moved in the assembly direction and the catch hook transferred from the latching element to its release position.

The catch hook 24 is adjustable between a fixing position shown in FIGS. 6, 7, 8 and 10 and a release position shown in FIG. 9. To adjust the catch hook 24, it has an insertion slope 25 which forms an acute angle with the assembly direction M. When the lid-side connecting element 14 is moved in the direction of assembly direction M, the latching element 23 first comes into contact with the insertion slope 25 of the catch hook 24 and presses the catch hook 24 from its fixing position into its release position (FIG. 9). When moving further in assembly direction M, the catch hook 24 springs back into its fixing position and secures the latching element 23 (FIG. 10).

For manual adjustment of the catch hook 24, the fixation device 22 also has a unlocking lever 28, by means of which the catch hook 24 can be adjusted manually. The catch hook 24 is subjected to force in the direction towards its fixing position via a spring element 27, the spring element 27 being arranged on a pivot pin 26 about which the catch hook 24 can be pivoted.

The pivot-arm-side connecting element 12 has a securing recess 29, in which, in the assembled state of the lid-side connecting element 14, the latching element 23 engages as a securing element. In the embodiment shown, the latching element 23 thus has two functions. On the one hand, the latching element secures the lid-side connecting element 14 on the pivot arm-side connecting element 12 against displacement in and against the assembly direction M by engaging behind the catch hook 24. On the other hand, the latching element 23 secures the lid-side connecting element 14 against displacement transverse to the assembly direction M by engaging in the securing recess 29. The latter function can alternatively be fulfilled by a separate securing element, for example in the form of a separate pin-shaped element.

Further, the securing element can alternatively be arranged on the pivot-arm-side connecting element 12, the securing recess 29 then being arranged on the lid-side connecting element 14.

List of Reference Signs

1 Furniture body
2 Furniture lid
3 Lid fitting
4 Side wall
5 Bottom panel
6 Top panel
7 Rear panel
8 Intermediate shelf
9 Opening
10 Base element
11 Pivot arm
12 Pivot-arm-side connecting element
13 Control arm
14 Lid-side connecting element
15 Mounting surface
16 Inner surface
17 Ramp surface
18 Sliding element
19 Supporting surface
20 Locking projection
21 Locking projection
22 Fixation device
23 Latching element
24 Catch hook
25 Insertion slope
26 Pivot pin
27 Spring element
28 Unlocking lever
29 Securing recess
30 Fastening screw

31 Gap
a1 Distance
a2 Distance
D Lid plane
M Assembly direction
O Opening plane

The invention claimed is:

1. A method for pivotally attaching a furniture lid to a furniture body by means of a lid fitting, wherein the lid fitting comprises:

a base element, a pivot arm, which is pivotally attached to the base element, a pivot-arm-side connecting element, which is pivotably connected to the pivot arm, a lid-side connecting element, which has a mounting surface arranged parallel to the lid plane (D), a ramp surface on one of the two connecting elements, which is arranged at an angle to the mounting surface, and a sliding element arranged on the other one of the two connecting elements, with the following method steps:

fastening the base element to a side wall of the furniture body in such a way that the pivot-arm-side connecting element is arranged inside the furniture body, fastening the lid-side connecting element to the furniture lid, placing the furniture lid against an opening in the furniture body and moving the furniture lid relative to the pivot-arm-side connecting element in an assembly direction parallel to the mounting surface in such a way that the sliding element slides along the ramp surface and the pivot-arm-side connecting element is pulled towards the lid-side connecting element in the direction towards the opening of the furniture body.

2. Method according to claim 1, wherein the fastening of the base element to the side wall of the furniture body comprises transferring of the lid fitting into an assembly position in which the pivot-arm-side connecting element is located completely within the furniture body.

3. Method according to claim 2, wherein, by moving the lid fitting into the assembly position, the pivot-arm-side connecting element is arranged offset inwards at a first distance (a1) from an opening plane (O) of the furniture body.

4. Method according to claim 2, wherein the furniture lid is moved relative to the pivot-arm-side connecting element until it reaches an assembled state in which the pivot-arm-side connecting element moved away from the assembly position in the direction towards the open position.

5. Method according to cone of claim 2, wherein the furniture lid is moved relative to the pivot-arm-side connecting element until it reaches an assembled state in which the pivot-arm-side connecting element projects outwards from the furniture body by a second distance (a2).

* * * * *